US009572408B2

(12) United States Patent
Heinz et al.

(10) Patent No.: US 9,572,408 B2
(45) Date of Patent: Feb. 21, 2017

(54) ITEM OF JEWELRY HAVING MOVABLE PARTS

(75) Inventors: Martin Heinz, Koenigsbach-Stein (DE); Karl Burth, Pforzheim (DE); Dieter Luz, Ispringen (DE)

(73) Assignee: Joerg HEINZ GmbH & Co. KG, Neulingen-Goebrichen (DE)

( * ) Notice: Subject to any disclaimer, the term of this patent is extended or adjusted under 35 U.S.C. 154(b) by 0 days.

(21) Appl. No.: 13/575,147

(22) PCT Filed: Jan. 25, 2011

(86) PCT No.: PCT/DE2011/000067
§ 371 (c)(1),
(2), (4) Date: Sep. 13, 2012

(87) PCT Pub. No.: WO2011/088827
PCT Pub. Date: Jul. 28, 2011

(65) Prior Publication Data

US 2013/0000354 A1 Jan. 3, 2013

(30) Foreign Application Priority Data

Jan. 25, 2010 (DE) ..... 10 2010 005 764
Feb. 5, 2010 (DE) ..... 10 2010 007 187

(51) Int. Cl.
*A44C 25/00* (2006.01)
*A44C 17/02* (2006.01)

(52) U.S. Cl.
CPC ..... *A44C 25/001* (2013.01); *A44C 17/0258* (2013.01)

(58) Field of Classification Search
CPC ... A44C 17/0258; A44C 25/00; A44C 25/001; A44C 25/002
USPC ..... 63/38, 39, 23, 21; 33/18.1; 40/1.6, 493; 16/303
See application file for complete search history.

(56) References Cited

U.S. PATENT DOCUMENTS

| | | | | |
|---|---|---|---|---|
| 408,955 | A | 8/1889 | Davies | |
| 2,416,034 | A * | 2/1947 | Weed | 63/3.1 |
| 4,184,344 | A | 1/1980 | Pepin | |
| 6,766,657 | B1 * | 7/2004 | Chien | 63/15.1 |
| 7,578,084 | B2 * | 8/2009 | Wu | 40/495 |
| 7,712,332 | B2 * | 5/2010 | Wright | 63/3 |
| 8,490,429 | B2 * | 7/2013 | Huynh | 63/29.2 |

(Continued)

FOREIGN PATENT DOCUMENTS

| | | |
|---|---|---|
| DE | 37 23 043 | 2/1989 |
| DE | 298 19 847 | 2/1999 |

(Continued)

OTHER PUBLICATIONS

German Office Action Issued May 25, 2010 in German Application No. 10 2010 007 187.0-56 Filed Feb. 5, 2010.

(Continued)

*Primary Examiner* — Emily Morgan
(74) *Attorney, Agent, or Firm* — Oblon, McClelland, Maier & Neustadt, L.L.P.

(57) ABSTRACT

The invention relates to an item of jewelry, comprising a fastener (2), an outer part (3), and an inner part (4) rotatable therein. The fastener can move in a reciprocating manner relative to the outer part, and an entrainment means (5) is provided between the fastener and the inner part in order to rotate the inner part in one direction when certain movements are made.

12 Claims, 6 Drawing Sheets

(56) References Cited

U.S. PATENT DOCUMENTS

Figure 1:
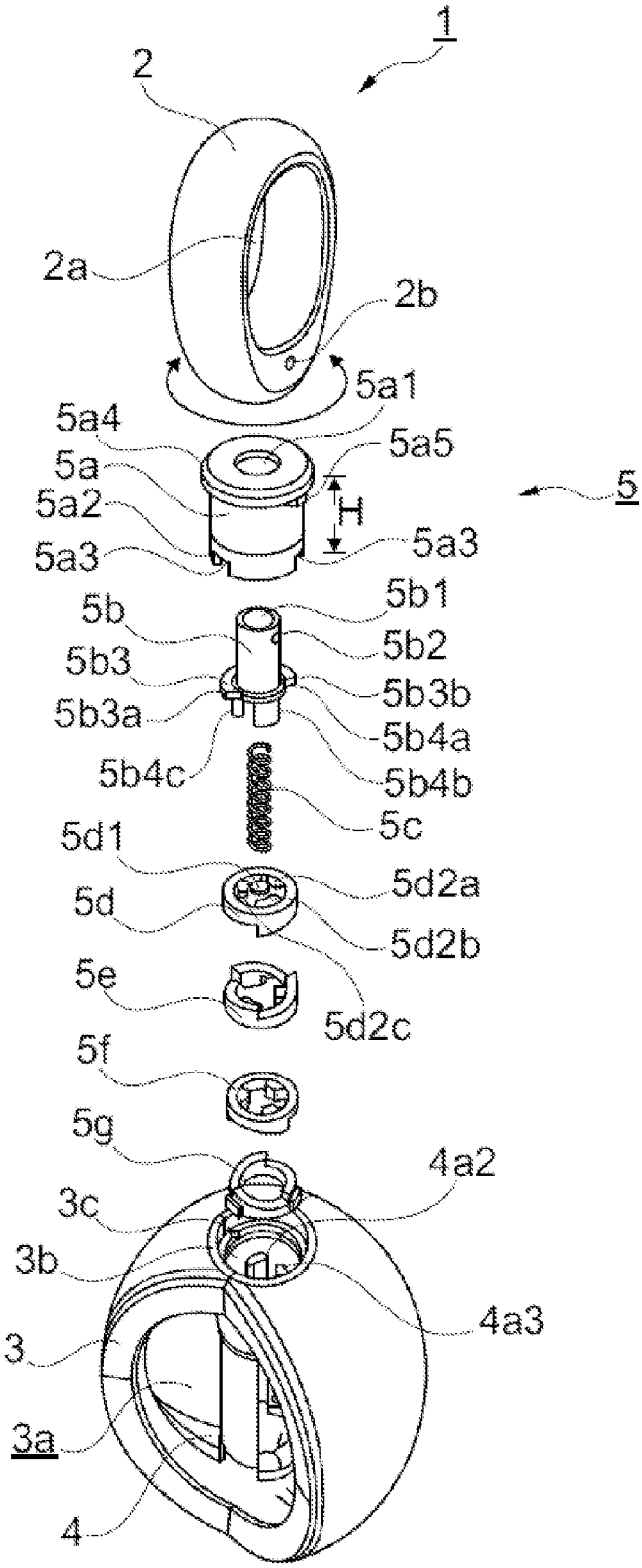

| | | | | |
|---|---|---|---|---|
| 2008/0078206 | A1* | 4/2008 | Wright | 63/13 |
| 2008/0222931 | A1* | 9/2008 | Wu | 40/493 |

FOREIGN PATENT DOCUMENTS

| | | |
|---|---|---|
| DE | 202 07 177 | 8/2002 |
| DE | 10 2009 008 409 | 12/2010 |
| FR | 1 541 110 | 10/1968 |
| FR | 2 344 245 | 10/1977 |

OTHER PUBLICATIONS

International Search Report Issued Jun. 8, 2011 in PCT/DE11/000067 Filed Jan. 25, 2011.

* cited by examiner

ITEM OF JEWELRY HAVING MOVABLE PARTS

The present invention relates to the subject matter claimed as stated in the preamble, and thus refers to items of jewelry, in particular having pendants, which include movable parts.

High-quality jewelry is not characterized only by the use of particularly expensive materials but also by the fact that the work on these is of high quality. A preferred way of demonstrating that the work is of high quality consists in providing movable parts on the item of jewelry. At the same time, the mobility of items of jewelry may be used to provide the observer with different views of the item of jewelry, which emphasizes the high quality. Here, however, it is significant that the movement mechanism imparts a high-quality feel when touched and in particular can be actuated with virtually no play. Items of jewelry are known in which two outer elements may be folded in various positions around an inner element, wherein they may adopt a plurality of stable positions.

The object of the present invention is to specify a further high-quality item of jewelry which may be formed such that it is appealing both to look at and when touched.

The object of the present invention is achieved by the subject matter of the independent claim; preferred embodiments can be found in the subclaims.

According to a first aspect of the invention, an item of jewelry having a fastening, an outer part and, rotatable therein, an inner part is thus proposed, in which it is provided that the fastening is movable to and fro in relation to the outer part and furthermore an entraining means is provided between the fastening and the inner part in order to rotate the inner part in one direction in the event of certain movements.

A first basic concept can thus be seen in the fact that, although the fastening is movable to and fro in relation to the outer part and the inner part is entrained by the fastening, it is only moved by being rotated in a predetermined direction in the event of certain movements of the fastening. Thus, first of all a movement of the inner part in relation to the outer part which would otherwise be largely uncontrolled, as would be possible if it were not restricted to certain movements, is avoided, and at the same time the fact is conveyed that a certain actuation is possible. In a particularly preferred form, the entraining means may be form-fittingly blocked to prevent certain movements, and a frictional engagement of elements of the entraining means with one another may be provided, wherein the friction is overcome when there is form-fitting blocking.

Typically, the fastening will have an eyelet through which a chain may be guided such that the item of jewelry may be suspended on a chain or similar. However, its use as an item of jewelry for the ear, or as a brooch, should also be mentioned by way of example.

In a preferred variant, the outer part will have a break-through through which the inner part is visible. Moving the inner part then has the result that the inner part moves behind the aperture, and this feature can be used to present different views of the inner part through the aperture.

The inner part will preferably have a region which is optionally arranged completely directly behind the aperture, or oriented completely away therefrom. This region may in particular be a cavity which is either open or completely covered.

Preferably, the entraining element will be constructed for rotating the inner part during a predetermined phase of the to-and-fro movement, that is to say it will rotate only in one direction of movement. As an alternative, it would also be possible to permit movement either to or fro, for example as a function of an axial position of the fastening.

In a particularly preferred variant, the to-and-fro movement may be an axial movement which is performed by the fastening along the axis of rotation, and the entraining element is constructed for converting it to a rotary movement. In a case of this kind the entraining means may include a geared pair of track-and-cam elements for converting the axial movement to the rotary movement. The reader is referred here to the corresponding entraining means, which are known per se in the art, as known for example from retractable ballpoint pens.

In an alternative and particularly preferred variant, the to-and-fro movement is already a rotary movement and the entraining means is constructed for entraining the inner part in a rotary movement in the direction of rotation, wherein this rotation may be limited.

Figure 2:
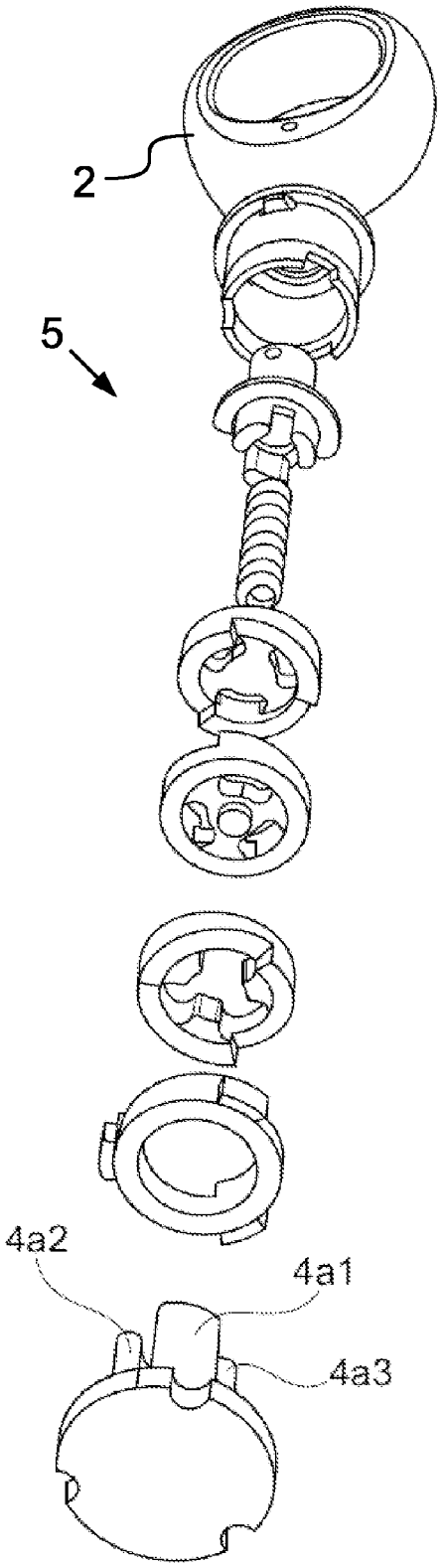
Figure 3:
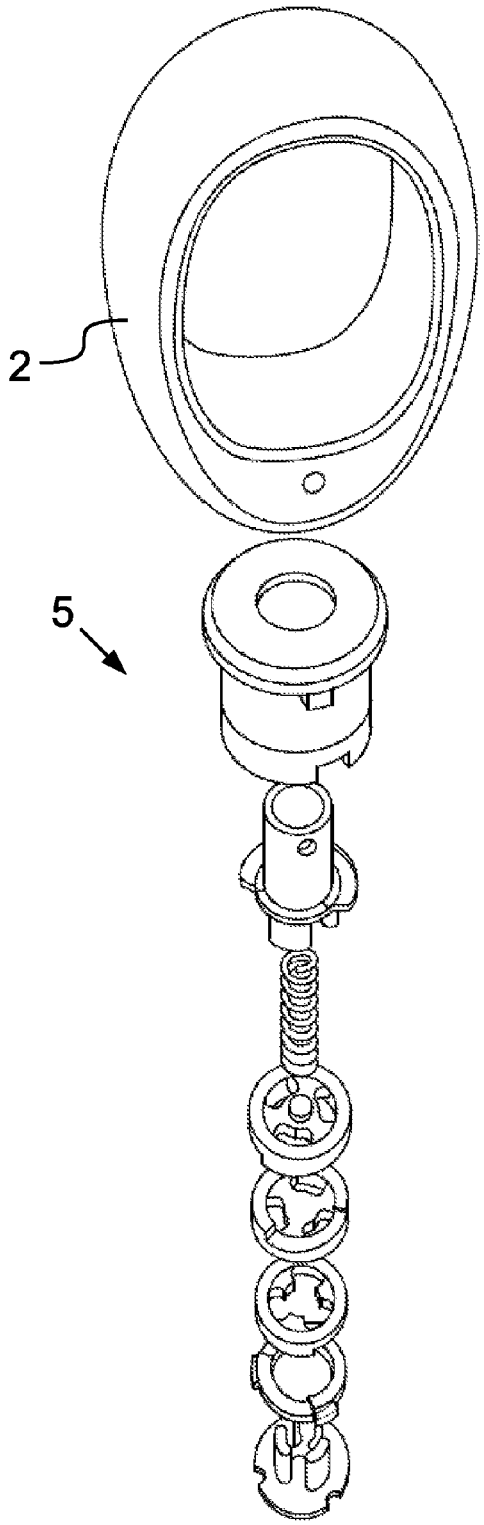

The invention will be described below, purely by way of example, with reference to the drawing. In the drawing:

FIG. 1 illustrates an exploded view of an item of jewelry according to the invention, FIG. 2 illustrates the exploded view from FIG. 1, from a different direction, FIG. 3 illustrates a further view of the item of jewelry from FIG. 1, and FIGS. 4A-4D illustrate an alternative embodiment for an axial movement of the fastening means.

FIG. 1 illustrates an item of jewelry 1, which is generally designated 1 and has a fastening 2, an outer part 3 and, rotatable therein, an inner part 4, wherein the fastening 2 is movable to and fro in relation to the outer part 3 and an entraining means 5 is provided between the fastening 2 and the inner part 4 in order to rotate the inner part 4 in one direction in the event of certain movements.

In the present case, the item of jewelry 1 is a high-quality item of jewelry whereof the fastening 2 has an eyelet 2*a* for a chain (not shown). The fastening 2 is dimensioned such that it can easily be grasped and moved by two fingers. The outer part 3 is in the present case formed to have an aperture 3*a*, which is open to an angle of approximately 120°. Different regions of the inner part 4 may be rotated such that they come in front of the opening 3*a*; these different regions of the inner part 4 are designed in a visually distinct manner. In the exemplary embodiment illustrated, the inner part 4, similarly, takes the form of a cavity, with the result that the latter is either rotated such that it comes in front of the opening 3*a* in the outer part or is completely covered thereby. The inner part 4 is mounted rotatably or pivotably inside the multiple-part outer part, on the side remote from the fastening 2 (mounting not shown). On the side facing the fastening 2, the outer part 3 has a further cutout 3*b* through which there pass entraining fingers 4*a*1, 4*a*2, 4*a*3 that are provided on the inner part 4.

In the present embodiment, starting from the fastening and looking toward the inner and outer parts, the entraining means includes a sleeve 5*a*, an element 5*b* acting as a sleeve insert, a pressure spring 5*c* and four annular plates 5*d*, 5*e*, 5*f* and 5*g*, wherein the plate rings 5*d*, 5*e* have teeth that point toward one another and the plate rings 5*f*, 5*g* similarly have teeth that point toward one another.

The sleeve 5*a* has a central opening 5*a*1, which points toward the fastening 2 and through which the upper side 5*b*1 of the element 5*b* can pass. In so doing, the element 5*b* can pass through the opening 5*a*1 far enough for a transverse bore 5*b*2 in the element 5*b* to come in front of a transverse bore 2*b* in the fastening 2, with the result that the element 5*b* may be secured by means of a pin (not shown) that passes through the bore 2*b* and the transverse bore 5*b*2. The element 5*b* has around its periphery a collar-like widened portion 5*b*3, out of which a circular segment is cut, with the result that two abutment shoulders 5*b*3*a* and 5*b*3*b* are formed. A projecting structure is provided in the interior of the sleeve 5*a*, and against this either the shoulder 5*b*3*a* abuts in one rotary position, or the shoulder 5*b*3*b* abuts in the opposing direction of rotation. In this way, the to-and-fro rotary movement of the fastening 2, which is connected such that it cannot rotate relative to the element 5*b*, in relation to the sleeve 5*a* is restricted. The sleeve 5*a* is of a height H which is sufficient to receive the elements 5*b*-5*g* therein.

The external diameter of the sleeve 5*a* corresponds to the internal diameter of the opening 3*b* in the outer part 3. However, the sleeve 5*a* has a collar 5*a*4 that resembles a fastening, by means of which it protrudes beyond the inner part of the passage opening in the outer part. Complementary lugs 5*a*5 and recesses 3*c* are provided in the outer part and the collar respectively, in order to create a connection between the sleeve 5*a* and the outer part 3 that prevents them from rotating relative to one another by form fit. On its lower rim region 5*a*2 that faces the outer part, the sleeve 5*a* has a number of notches 5*a*3, which in this case are rectangular in shape, into which lugs of complementary shape on the bottom-most annular plate 5*g* penetrate in order to secure the latter to prevent rotation relative to the sleeve. In the fully assembled item of jewelry, it is also possible to make a permanent connection, for example using solder, in addition and/or as an alternative thereto.

The element 5*b* is formed such that it is hollow on the inside in order to receive in its interior the pressure spring 5*c*, which is seated on a lug 5*d*1 on the annular plate 5*d*. The element 5*b* has, facing the annular plate 5*d*, three entraining fingers 5*b*4*a*, 5*b*4*b*, 5*b*4*c*, which enter respective openings of complementary shape in the annular plate 5*d*, that is to say the openings 5*d*2*a*, 5*d*2*b*, 5*d*2*c*.

The annular plate 5*f* also has cutouts, through which the fingers 4*a*1-4*a*3 that protrude upward from the inner part 4 penetrate namely as far as the cutouts complementary to the finger in the annular plate 5*e* that is closer to the fastening. The central cutout in the annular plate 5*g* is large enough for the latter to be freely rotatable around the fingers 4*a*1-4*a*3. As can be seen from FIG. 2 and FIG. 3, the inner part need not be made in one piece.

According to the above, the following parts are therefore connected to one another such that they cannot rotate relative to one another: the fastening 2 is connected, by way of the transverse pin, to the element 5*b*, and the latter is connected by way of the fingers 5*b*4*a*, 5*b*4*b*, 5*b*4*c* to the annular plate 5*d*.

By contrast, the inner part 4 is connected by way of the fingers 4*a*1-4*a*3 to the annular plate 5*e*, whereas the annular plate 5*g* is per se freely rotatable about the fingers. The sleeve is connected to the lower annular plate 5*g* such that it cannot rotate relative thereto. The teeth on the annular plates 5*d*-5*g* ensure that the rotation of the fastening eyelet is transmitted to parts in engagement therewith only on rotation in one direction.

After assembly, the arrangement can be used as follows:

The item of jewelry is fastened to a chain that is guided through the eyelet 2*a* of the fastening 2. The outer part 4 may be held still by two fingers of one hand and the fastening 2 may be rotated to and fro in relation thereto, including while it is being worn.

On rotation in one direction clockwise in the exemplary embodiment that is shown - a rotary moment of the fastening 2 is, by way of the element 5*b* and the fingers 5*b*4*a*-5*b*4*c* thereof, transmitted to the element 5*d* and will thus by the meshing of teeth entrain element 5*e* in a rotary movement. The element 5*e*, by way of the fingers 4*a*1-4*a*3, in turn entrains the inner part such that the inner part will rotate in relation to the outer part, which is held still. As soon as the shoulder 5*b*3*a* is in abutment with the structure (which is not shown) inside the sleeve, further rotation of the fastening 2 is restricted.

On rotating back, the annular plate 5*d* will slide on the annular plate 5*e*. In this direction of rotation, entrainment is thus only possible as a result of friction between the teeth but is not possible as a result of their form fit. For this reason, return movement will only continue until the teeth of the elements 5*f* and 5*g* have come into abutment, which ensures that the inner part is in precise and correct alignment in relation to the outer part, in a precisely predetermined position. Then, the fastening will be rotated back without further entraining the inner part or other parts, because further movement of the other parts is blocked. In this arrangement, the fastening will be able to rotate back until the second set of teeth comes into engagement, between the annular plates 5*d* and 5*e*. The fastening 2 is then back in its starting position, not turned.

In this way, precise movement of the inner part can be achieved by a to-and-fro rotation of the fastening.

Figure 4A:
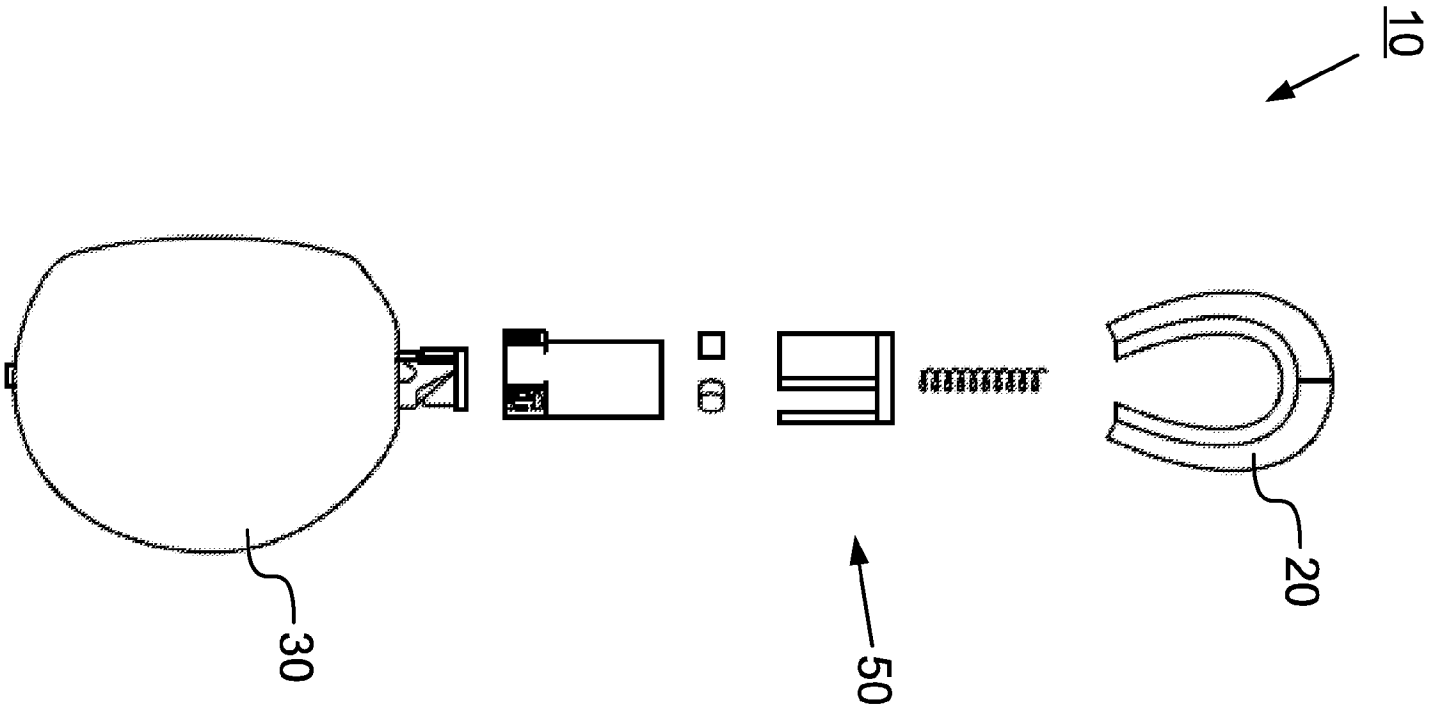
Figure 4B:
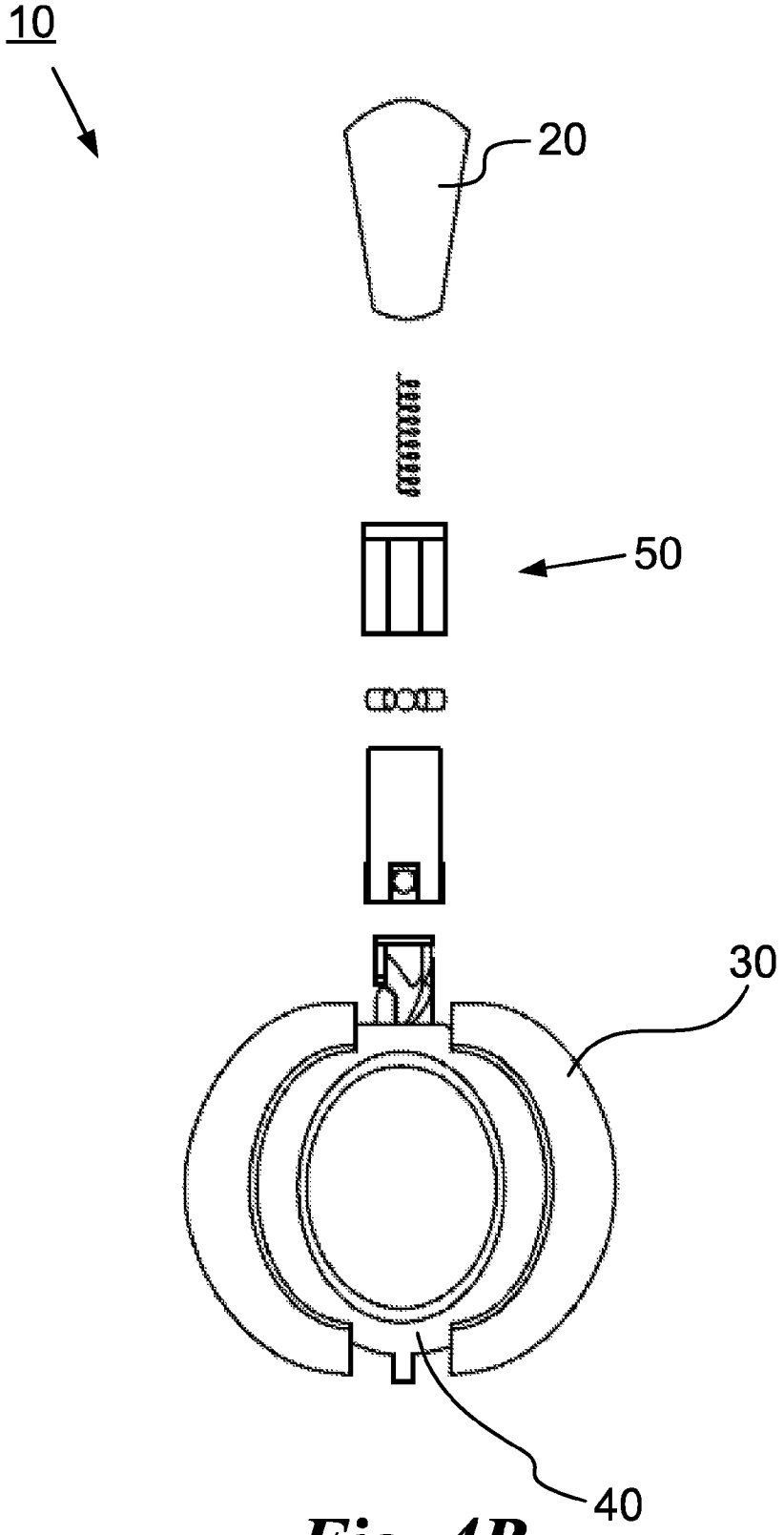
Figure 4C:
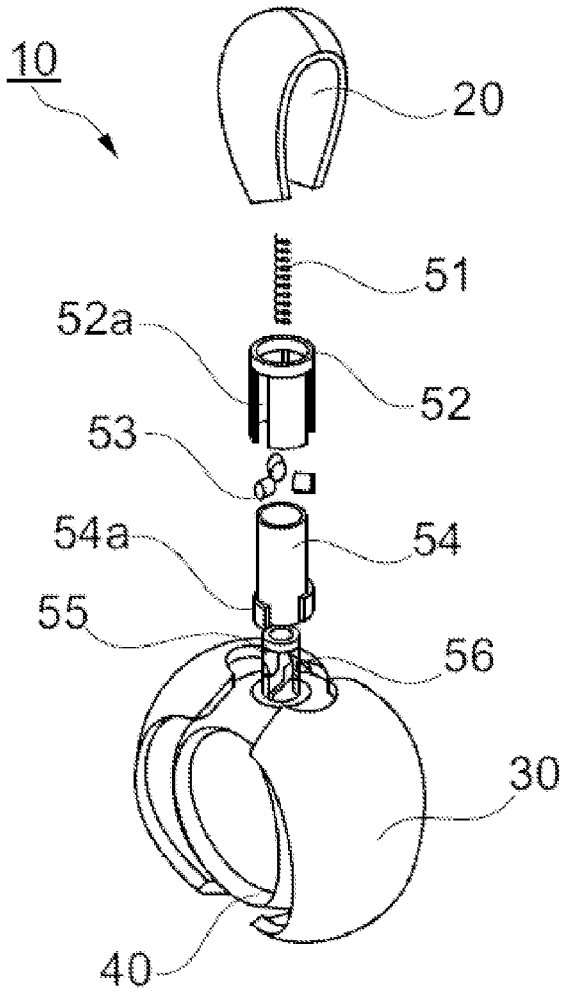
Figure 4D:
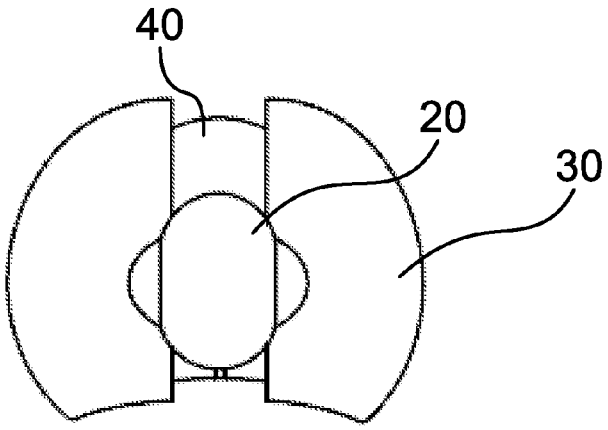

A further embodiment is shown in FIGS. 4A-4D. FIG. 4A is a side view of an item of jewelry 10, FIG. 4B is a front view thereof, FIG. 4C is a perspective view thereof, and FIG. 4D is a top view thereof. The item of jewelry 10 has a fastening 20, an outer part 30 and an inner part 40 between which there is provided an entraining element 50, in order to rotate the inner part 40 in one direction in the event of certain movements of the fastening 20.

As labeled in FIG. 4C, the entraining element 50 has a pressure spring 51, an outer sleeve 52, cams 53, an inner sleeve 54 and a peg 55 having a cam track 56 for the cams. The outer sleeve 52 has cutouts 52*a* in which lugs 54*a* on the inner sleeve can slide axially. The lugs 54*a* are provided with bores for the cams 53, which penetrate into the cam track 56 on the peg 55. The cam track 56 is shaped such that in the event of a to-and-fro movement the fastening 20 the cams, which slide on the cam track and are connected to the outer part such that they cannot rotate relative thereto, cause the peg 55 and hence the inner part 40 to rotate. In this way, an axial movement of the fastening can be converted into a rotation of the inner part.

The invention claimed is:

1. An item of jewelry comprising:

an outer part including an aperture;

an inner part rotatable within the outer part and visible through the aperture so as to present different views of the inner part through the aperture on rotation;

a fastening including an eyelet, wherein the fastening is rotatable relative to the outer part in to and fro directions, the fastening is dimensioned to be manipulable with two fingers, the inner part is movable by the fastening, and movement of the fastening is restricted;

an assembly provided between the fastening and the inner part, the assembly including:

a sleeve, four annular plates movable relative to each other within the sleeve, and a pressure spring to press at least two annular plates against each other, wherein the four annular plates include teeth and form first and second pairs, the teeth of the first pair of annular plates pointing to each other and the teeth of the second pair pointing to one another, a first annular plate of the first pair being connected to the fastening such that the first annular plate of the first pair and the fastening cannot rotate relative to one another, a second annular plate of the first pair being connected to the inner part such that the second annular plate of the first pair and the inner part cannot rotate relative to one another, the teeth of the first pair being such that, on a to-rotation of the fastening, the first and second annular plates are co-rotated with the fastening, while a second annular plate of the second pair being connected to the outer part such that the second annular plate of the second pair and the outer part cannot rotate relative to one another, a first annular plate of the second pair being connected to the inner part such that the first annular plate of the second pair and the inner part cannot rotate freely relative to one another, the teeth of the first pair being oriented such that the teeth will mesh with each other to co-rotate the inner part while rotating the fastening in the to-direction and such that the first and second annular plates of the first pair rotate together via friction during rotation of the fastening in the fro-direction due to increased pressure between the annular plates of the first pair caused by the pressure spring until the second annular plate of the second pair is blocked by the first annular plate of the second pair, the teeth of the second pair being oriented so as to rotate the inner part during rotation of the fastening in the to-direction and to restrict a range of rotation of the fastening in the fro-direction.

2. The item of jewelry according to claim 1, wherein the assembly effects rotation of the inner part only during only a predetermined portion of a movement range of the assembly.

3. The item of jewelry according to claim 2, wherein movement of the fastening in the to and fro directions is a rotary movement with a limited angle of rotation.

4. The item of jewelry according to claim 3, wherein the inner part comprises a cavity that is selectively positionable completely behind the aperture and completely away from the aperture.

5. The item of jewelry according to claim 1, wherein the sleeve is connected to the outer part such that the sleeve and the outer part cannot rotate relative to one another.

6. An item of jewelry comprising:

an outer part including an aperture;

an inner part rotatable within the outer part and visible through the aperture so as to present different views of the inner part through the aperture on rotation;

a fastening including an eyelet, wherein the fastening is rotatable relative to the outer part in to and fro directions, the fastening is dimensioned to be manipulable with two fingers, the inner part is movable by the fastening, and movement of the fastening is restricted;

an assembly provided between the fastening and the inner part, the assembly including:

a sleeve, four annular plates movable relative to each other within the sleeve, and a pressure spring in addition to the annular plates, the pressure spring adapted to press at least two annular plates against each other, wherein at least one of the four annular plates is connected to the fastening such that they cannot rotate relative to one another, at least one of the four annular plates is connected to the inner part such that they cannot rotate relative to one another, the four annular plates including thereon teeth and forming first and second pairs, the teeth of each pair pointing to each other, the teeth of the first pair being such that, on a to-rotation of the fastening relative to the outer part, the teeth mesh with each other and the annular plate connected to the fastening and the at least one annular plate being connected to the inner part are co-rotated with the fastening, while, on a fro-rotation of the fastening relative to the outer part, the annular plates of the first pair rotate together via friction due to increased pressure between the annular plates of the first pair caused by the pressure spring until the second annular plate of the second pair is blocked by the first annular plate of the second pair, the teeth of the second pair being oriented so as to rotate the inner part during rotation of the fastening in the to-direction and to restrict a range of rotation of the fastening in the fro-direction.

7. The item of jewelry according to claim 6, wherein one of the four annular plates is connected to the outer part such that they cannot rotate relative to one another, the teeth of the second pair being provided on the one hand on an annular plate connected to the outer part such that they cannot rotate relative to one another, and on the other hand on the at least one annular plate connected to the inner part such that they cannot rotate relative to one another.

8. The item according to claim 6, wherein the sleeve is connected to the outer part such that they cannot rotate relative to one another.

9. The item according to claim 6, wherein the assembly effects rotation of the inner part only during only a predetermined portion of a movement range of the assembly.

10. The item according to claim 9, wherein movement of the fastening in the to and fro directions is a rotary movement with a limited angle of rotation.

11. The item of jewelry according to claim 10, wherein the inner part comprises a cavity that is selectively positionable completely behind the aperture and completely away from the aperture.

12. The item of jewelry according to claim 6, wherein at least one of the fastening and the outer part is dimensioned to be holdable with two fingers.

* * * * *